US007721611B2

(12) United States Patent
Salama

(10) Patent No.: US 7,721,611 B2
(45) Date of Patent: May 25, 2010

(54) COMPOSITE RISER WITH INTEGRITY MONITORING APPARATUS AND METHOD

(75) Inventor: Mamdouh M. Salama, Richmond, TX (US)

(73) Assignee: ConocoPhillips Company, Houston, TX (US)

( * ) Notice: Subject to any disclaimer, the term of this patent is extended or adjusted under 35 U.S.C. 154(b) by 68 days.

(21) Appl. No.: 11/671,896

(22) Filed: Feb. 6, 2007

(65) Prior Publication Data

US 2008/0249720 A1 Oct. 9, 2008

Related U.S. Application Data

(62) Division of application No. 10/704,079, filed on Nov. 7, 2003, now abandoned.

(51) Int. Cl.
*G01L 1/22* (2006.01)

(52) U.S. Cl. ..... 73/862.627

(58) Field of Classification Search ..... 73/862.627
See application file for complete search history.

(56) References Cited

U.S. PATENT DOCUMENTS

| | | | |
|---|---|---|---|
| 2,661,225 | A | 12/1953 | Lyon |
| 2,750,210 | A | 6/1956 | Trogdon et al. |
| 2,973,975 | A | 3/1961 | Ramberg et al. |
| 3,119,415 | A | 1/1964 | Galloway et al. |
| 3,189,370 | A | 6/1965 | Marshall |
| 3,347,571 | A | 10/1967 | New |
| 3,423,109 | A | 1/1969 | New et al. |
| 3,529,853 | A | 9/1970 | Triest el al. |
| 3,537,484 | A | 11/1970 | McLarty |
| 3,538,238 | A | 11/1970 | Delacour et al. |
| 3,651,661 | A | 3/1972 | Darrow |
| 3,768,269 | A | 10/1973 | Broussard et al. |
| 3,768,842 | A | 10/1973 | Ahlstone |
| 3,992,240 | A | 11/1976 | Kuehn, Jr. |
| 4,023,835 | A | 5/1977 | Ewing et al. |
| 4,116,009 | A | 9/1978 | Daubin |
| 4,187,135 | A | 2/1980 | Yates et al. |
| 4,192,351 | A | 3/1980 | Henry |
| 4,231,436 | A | 11/1980 | Waller |
| 4,236,386 | A | 12/1980 | Yates et al. |
| 4,259,382 | A | 3/1981 | Schwan |

(Continued)

FOREIGN PATENT DOCUMENTS

CA 2320028 A1 3/2001

(Continued)

OTHER PUBLICATIONS

D. D. Baldwin et al, "Composite Production Riser Design", Offshore Technology Conference, May 1997, pp. 1-8.

(Continued)

*Primary Examiner*—Lisa M Caputo
*Assistant Examiner*—Octavia Davis

(57) ABSTRACT

An integrity monitoring system for monitoring degradation in a composite riser string. The system includes composite riser structures incorporating strain and vibration sensors to measure changes in the stiffness strain on a first orientation and on a second orientation. The system can also include monitoring modules attached to each individual riser and devices to transfer the data from the monitoring module to the surface controller. Additionally, the monitor system can provide for an alarm when predetermined warning limits are exceeded.

13 Claims, 8 Drawing Sheets

U.S. PATENT DOCUMENTS 4,265,951 A 5/1981 Yates et al.
4,279,275 A 7/1981 Stanwood et al.
4,290,836 A 9/1981 McPherson et al.
4,332,509 A 6/1982 Reynard et al.
4,589,801 A 5/1986 Salama
4,614,372 A 9/1986 Gschwind
4,634,314 A 1/1987 Pierce
4,647,078 A 3/1987 Lundy
4,663,628 A 5/1987 Duncan et al.
4,664,644 A 5/1987 Kumata et al.
4,701,231 A 10/1987 Peters et al.
4,728,224 A 3/1988 Salama et al.
4,755,076 A 7/1988 Salama et al.
4,810,010 A 3/1989 Jones
4,821,804 A 4/1989 Pierce
4,830,409 A 5/1989 Freeman
4,849,668 A 7/1989 Crawley et al.
4,865,356 A 9/1989 Moore et al.
4,875,717 A 10/1989 Policelli
4,932,264 A 6/1990 Hawkins et al.
4,968,545 A 11/1990 Fellman et al.
4,979,992 A 12/1990 Bache
4,990,030 A 2/1991 Salama et al.
5,018,583 A 5/1991 Williams
5,039,255 A 8/1991 Salama
5,042,600 A 8/1991 Finnegan et al.
5,062,914 A 11/1991 Fuchs et al.
5,080,175 A 1/1992 Williams
5,086,651 A 2/1992 Westermo et al.
5,092,713 A 3/1992 Salama
5,094,527 A 3/1992 Martin
5,097,870 A 3/1992 Williams
5,172,765 A 12/1992 Sas-Jaworsky et al.
5,176,180 A 1/1993 Williams et al.
5,200,012 A 4/1993 Blavignac et al.
5,209,136 A 5/1993 Williams
5,230,661 A 7/1993 Schreiber et al.
5,233,737 A 8/1993 Policelli
5,234,058 A 8/1993 Sas-Jaworsky et al.
5,285,008 A 2/1994 Sas-Jaworsky et al.
5,288,109 A 2/1994 Auberon et al.
5,309,620 A 5/1994 Shinohara et al.
5,318,374 A 6/1994 Rumberger
5,330,236 A 7/1994 Peterjohn et al.
5,330,807 A 7/1994 Williams
5,332,049 A 7/1994 Tew
5,348,096 A 9/1994 Williams
5,363,929 A 11/1994 Williams et al.
5,398,975 A 3/1995 Simmons
5,423,389 A 6/1995 Warren et al.
5,439,323 A 8/1995 Nance
5,443,099 A 8/1995 Chaussepied et al.
5,469,916 A 11/1995 Sas-Jaworsky et al.
5,474,132 A 12/1995 Gallagher
5,507,346 A 4/1996 Gano et al.
5,520,223 A 5/1996 Iorio et al.
5,520,422 A 5/1996 Friedrich et al.
5,525,003 A 6/1996 Williams et al.
5,553,504 A 9/1996 Lyons et al.
5,581,248 A 12/1996 Spillman, Jr. et al.
5,604,336 A 2/1997 Johnson
5,613,794 A 3/1997 Isaac et al.
5,633,494 A 5/1997 Danisch
5,649,035 A 7/1997 Zimmerman et al.
5,675,089 A 10/1997 Hawkins
5,675,252 A 10/1997 Podney
5,770,155 A 6/1998 Dunphy et al.
5,771,975 A 6/1998 Anderson et al.
5,814,729 A 9/1998 Wu et al.
5,814,999 A 9/1998 Elie et al.
5,867,883 A 2/1999 Iorio et al.
5,868,437 A 2/1999 Teague
5,908,049 A 6/1999 Williams et al.
5,913,337 A 6/1999 Williams et al.
5,916,672 A 6/1999 Reeves et al.
5,921,285 A 7/1999 Quigley et al.
5,944,099 A 8/1999 Sas-Jaworsky
5,944,124 A 8/1999 Pomerleau et al.
5,979,288 A 11/1999 Gallagher et al.
5,988,702 A 11/1999 Sas-Jaworsky
6,004,639 A 12/1999 Quigley et al.
6,016,845 A 1/2000 Quigley et al.
6,042,152 A 3/2000 Baldwin et al.
6,047,094 A 4/2000 Kalamkarov et al.
6,048,428 A 4/2000 Millward et al.
6,050,612 A 4/2000 Wolterman
6,109,834 A 8/2000 Chitwood
6,148,866 A 11/2000 Quigley et al.
6,230,955 B1 5/2001 Parks
6,260,415 B1 7/2001 Goebel et al.
6,264,244 B1 7/2001 Isennock et al.
6,286,558 B1 9/2001 Quigley et al.
6,352,216 B1 3/2002 Coats
6,357,485 B2 3/2002 Quigley et al.
6,361,299 B1 3/2002 Quigley et al.
6,405,762 B1 6/2002 Bunch
6,435,447 B1 8/2002 Coats et al.
6,439,810 B1 8/2002 Nish et al.
6,450,259 B1 9/2002 Song et al.
6,454,014 B2 9/2002 Coats et al.
6,460,796 B1 10/2002 Berning et al.
6,491,779 B1 12/2002 Bryant
6,550,342 B2 * 4/2003 Croteau et al. ..... 73/800
6,585,455 B1 * 7/2003 Petersen et al. ..... 405/224.4
6,612,370 B1 9/2003 Jahnsen et al.
6,675,659 B1 1/2004 Louis-Calixte et al.
6,706,348 B2 3/2004 Quigley et al.
6,904,812 B2 6/2005 Miyazaki
6,913,079 B2 * 7/2005 Tubel ..... 166/250.01
6,932,542 B2 * 8/2005 Chianis et al. ..... 405/223.1
7,194,913 B2 * 3/2007 Morrison et al. ..... 73/800
2002/0014340 A1 2/2002 Johnson
2002/0157723 A1 10/2002 Odru
2004/0206187 A1 * 10/2004 Williams ..... 73/766

FOREIGN PATENT DOCUMENTS

DE 786197 11/1972
DE 38 15 173 A1 11/1989
EP 0 312 023 A2 4/1989
EP 0 266 810 B1 1/1992
EP 0 575 428 B1 12/1993
EP 0 511 138 B1 6/1995
EP 0 545 838 B1 9/1995
EP 0 520 013 B1 1/1998
EP 0 524 206 B1 5/1999
EP 1 067 324 A1 1/2001
EP 1 090 243 B1 8/2002
GB 2 161 568 A 1/1986
GB 2 258 899 A 2/1993
JP 3-218978 9/1991
RU 1629676 AU 2/1991
WO WO 94/15135 A1 7/1994
WO WO 96/12911 A1 5/1996
WO WO 96/33361 A1 10/1996
WO WO 98/36203 A1 8/1998
WO WO 99/08033 A1 2/1999
WO WO 99/17045 A1 4/1999
WO WO 99/19653 A1 4/1999
WO WO 99/67561 A1 12/1999

OTHER PUBLICATIONS

M. M. Salama, "Design Consideration For Composite Drilling Riser", Offshore Technology Conference, May 1999, pp. 1-11.
M. M. Salama, "The First Offshore Field Installation For A Composite Riser Joint", Offshore Technology Conference, May 2002, pp. 1-7.
P. Saad et al, "Application Of Composites To Deepwater Top Tensioned Riser Systems", ASME, Jun. 2002, pp. 1-7.
M. M. Salama, "Composite Production Riser—Testing and Qualification", Offshore Technology Conference, SPE Production & Facilities, Aug. 1998, pp. 170-177.
M. M. Salama, "Composite Risers Are Ready for Field Applications—Status of Technology, Field Demonstration and Life Cycle Economics", Offshore Technology Conference, October.
M. M. Salama, "Application and Remaining Challenges of Advanced Composites for Water Depth Sensitive Systems", Offshore Technology Conference, Nov. 2000, 15 pgs.
C. A. Lundberg et al, "Advances in Manufacturing Technology for Spoolable Composite Tubing", CAFC, pp. 289-302.
M. Salama et al., "In-Service Integrity Monitoring of Deepwater Composite Riser", 14th Intl. Deep Offshore Tech. Conf., Nov. 13-15, 2002, pp. 1-15, New Orleans, LA, USA.
Paolo Guaita, "Development of a New Fiber-Optic based Offshore Structural Monitoring System", SPE 56435, 1999, pp. 1-3, 6-11.
Jerry G. Williams et al., "Composite Spoolable Pipe Development, Advancements, and Limitations", Offshore Technology Conference 2000, pp. 327-342.

* cited by examiner

COMPOSITE RISER WITH INTEGRITY MONITORING APPARATUS AND METHOD

This is a divisional application of U.S. patent application Ser. No. 10/704,079 filed on Nov. 7, 2003.

TECHNICAL FIELD OF THE INVENTION

The present invention relates to composite structures, apparatus to monitor the integrity of composite structures, and a method to monitor changes in stiffness. The present invention relates to using displacement, strain and vibration sensors to monitor changes in the riser stiffness. In particular, the invention has particular application to composite risers used in offshore oil and gas production.

BACKGROUND OF THE INVENTION

In offshore oil and gas drilling, production, and completion operations a platform at the surface of the ocean is connected to the well head on the sea floor by risers. A riser is a tubular member through which drilling tools, tubing, and other components used in oil and gas exploration pass. The current practice is to make the risers from steel. More recently, it has been proposed that the risers be made from composite materials. Risers made from a composite material offer the advantage of being lighter in weight than steel risers. Thus, composite risers have the advantage of requiring a smaller surface platform to support the same length of composite riser than would be required with a steel riser.

Offshore oil and gas exploration is progressively moving to deeper and deeper water. Thus, the weight savings advantage of the composite riser become more significant as the water depth in which wells are drilled becomes greater. Some well heads are on the sea floor more than 5,000 feet below the surface of the ocean.

A concern with any deep water oil and gas exploration is maintaining the integrity of the riser system. Breaches in the riser system can result in the escape of drilling muds, oil and/or gas into the sea.

The use of composite risers in actual field applications is relatively new. Thus, there is little long-term experience concerning the reliability of composite risers. Clearly, failure or breach of a riser is to be avoided. The present invention provides an apparatus and method for monitoring the integrity of composite risers by monitoring changes in the riser stiffness. Monitoring of the stiffness of the risers can allow identification of weakened risers and allow their replacement prior to failure. A change in the stiffness is monitored using strain sensors or vibration sensors.

Stiffness is defined as a measure of the amount of deformation per unit load. When a riser joint is new, it will have certain stiffness value and therefore when the joint is subjected to a certain load, the joint will deform to a certain level, which can be measured using displacement gauges or strain sensors. The strain is defined as the displacement per unit length of the section over which the displacement is measured. The virgin stiffness of a riser joint can be predicted using numerical solutions and the amount of strain when the riser joint is subjected to a specific load can also be predicted using numerical solutions such as finite element analysis. When the riser is damaged, the stiffness will be reduced and the amount of deformation for the same load will be increased.

Stiffness of the composite riser is an important design parameter because high stiffness results in high loads when the riser stretches as the platform moves and low stiffness is not desirable because it can result in clashing between different risers. The axial stiffness of the riser is related to the elastic modulus of the riser, the cross sectional area and the length of the riser string. The length of the riser string is defined by the water depth and the cross sectional area is mainly established to ensure that the riser can withstand the design loads such as pressure, tension and bending loads. The elastic modulus is affected by the fibers used to manufacture the composite riser and the layout of the different laminates. While the currently used material, steel, has a fixed elastic modulus of 30 million lb/square inch (206.85 million kPa), composite risers can have different values. The present invention can be used with composite risers, the elastic axial modulus of which is between 5 to 15 million lb/square inch (34.475 and 103.425 million kPa), and preferably a value between 10 and 14 million lb/square inch (68.95 and 96.53 million kPa). Damage to the composite riser will manifest itself by a reduction of the riser's stiffness, indicating that the elastic modulus of the riser has been reduced.

It is also noted that the composite riser joint will fail when the strain in the riser reaches a specific value. This value is in the order of 0.5% for the carbon fiber composite risers being considered for offshore applications. An object of the present invention is to monitor riser strain either (1) on a continuous basis to assess the extent of damage and also the variation of loading, or (2) by monitoring for the maximum strain experienced in the riser until it reaches a specific value which is lower than the strain at which failure is expected. This will ensure sufficient time to remove the damaged joint prior to its failure. In another aspect, the present invention provides for using the natural vibration frequency of the riser to monitor the integrity of the riser. As the stiffness of the riser changes, its natural frequency, which is a function of the riser's stiffness and mass, will change and thus the riser's vibration signature will change. Although this is a well known technique, individual testing and the generation of custom strain curves is required to characterize a specific riser because configuration, cross-section, wall thickness, material selection, etc. will affect vibration response characteristics. Monitoring the changes in a riser's vibration signature, which is commonly done using accelerometers, can provide an indication of the level of damage to that riser. Because of the complexity of the composite structure, theoretical predictions of the relationship between level of damage and changes in strains or vibration signature are difficult. Therefore, calibration curves need to be developed as part of the riser qualification program. Developing these curves involves testing some composite joints to induce damage. In one embodiment of the invention, fiber optics are used as the strain sensors and a test method is provided demonstrating the qualification of the riser when strain monitoring is used.

SUMMARY OF THE INVENTION

In one aspect, the present invention relates to a composite structure adapted for the measurement of changes in the stiffness of the composite structure. In a preferred embodiment, the composite structure is a composite riser having a metal liner with metal composite interfaces attached to each end. The riser is covered with one or more composite structural members. The riser includes at least one strain gauge attached to the riser. Preferably, the riser includes a first strain sensor oriented in a first orientation and a second strain sensor oriented in a second orientation. These strain sensors can be of any known design; however, in the preferred embodiment the strain sensors are fiber optic strain gauges and electromagnetic sensors (steel elements) which are embedded in the riser during fabrication.

The strain gauges can be positioned in areas of interest. Typically, these areas of interest will be the areas most likely affected by internal damage to the composites; for example, the area where the composite structure and the metal connector interfaces are joined. This area is called the metal-composite interface (MCI).

In another embodiment, the present invention relates to monitoring changes in the composite riser stiffness using vibration monitors (e.g. accelerometers) that will allow for determining changes in the natural frequency and mode shape of the composite structure.

In another embodiment, the present invention relates to a monitoring system for a riser assembly. In this embodiment, a plurality of risers extend from the well head on the sea floor to the surface platform. In this embodiment, the strain sensors and the vibration monitors located in each riser are connected to a control unit on the surface platform. The control unit on the surface platform has a means to generate a signal to the individual strain sensor in each riser, to measure the strain and vibration response in each riser, and to record the measured strain and natural frequency. Preferably, the measured strain and/or natural frequency are recorded together with the time that the strain and/or the vibration responses are measured as well as the riser in which the responses were measured. Alternatively, the strain and/or vibration responses in only selected risers can be monitored.

In another embodiment of the present invention, a monitoring module is provided on an individual riser, although if desired, more than one monitoring unit can be employed. The use of a self-contained monitoring module obviates the need to connect the risers to the surface via a transmission line. The monitoring module has a power source, a processor unit, a communication device, and a signal device. The processor unit of the module has the capability of initiating the signal unit to send a signal to the sensor on the riser. The processor also includes an interface or other device to receive the measured data from the sensors, memory to store the measured data, and preferably signal processing capability to compare the measured data against a predetermined warning value. With a preferred embodiment, the processor unit also includes a signal processing capability to determine the ratio between the measured strains in either the first or second orientation against the strain measured in the other orientation. In yet another embodiment, the processor also includes a means to compare the determined ratio against a predetermined value of the ratio set as a warning limit. Preferably, the monitoring module also includes a memory or other storage means to store the measured strain values and/or the ratio of measured strain values. Additionally, the monitoring module contains a communication device to output the strain data and/or the stored values. The monitor module can also include a capability to initiate an alarm in the event the warning limit is exceeded.

The invention also is a control system for performing the monitoring of the strain. The control system components and functions can be integrated at a single location or dispersed to multiple locations. The control system can include an input interface to input data and commands such as riser identification, alarm limits, and commands to initiate measurement; a signal means to send and receive measurement signals to the strain gauges; a processing capability to receive the measured data and process the data as desired, e.g., compare the measured data to warning limits, store the data, and output the data; and a communication device for outputting data in a desired manner.

In another embodiment, the invention includes a remotely controlled submersible vehicle. This remotely controlled submersible vehicle includes a recorder device. In one aspect, the recorder includes a processor and a link device. The link device provides a communication link to the monitoring module. The processor includes a mechanism to initiate a download of stored strain measurements data or ratio data of strain measurements from the monitoring module, and a way to store the downloaded data. The recorder also includes a way to output these values when the submersible is recovered at the surface.

In another aspect, the recorder unit of the submersible vehicle includes a device to generate a signal to the strain gauges in the riser. The recorder includes a device to record the measured strain from the sensors in the individual risers. This embodiment is especially suited to the use of electromagnetic strain sensors.

The method of the present invention can include the steps of sending a signal to a strain and/or vibration measuring device in operative association with a composite riser, recovering the response to the signal, comparing the response to a warning limit, computing the ratio of response measured in one orientation to that measured in another orientation, comparing the computed ratio to a warning limit, outputting the data, storing the data, and initiating an alarm.

BRIEF DESCRIPTION OF THE DRAWINGS

The present invention will be better understood in light of the detailed description when read in conjunction with the drawings. Any drawings in detailed description represent certain embodiments of the invention and are not intended to be limiting of the invention. In the drawings.

DETAILED DESCRIPTION

Figure 1:
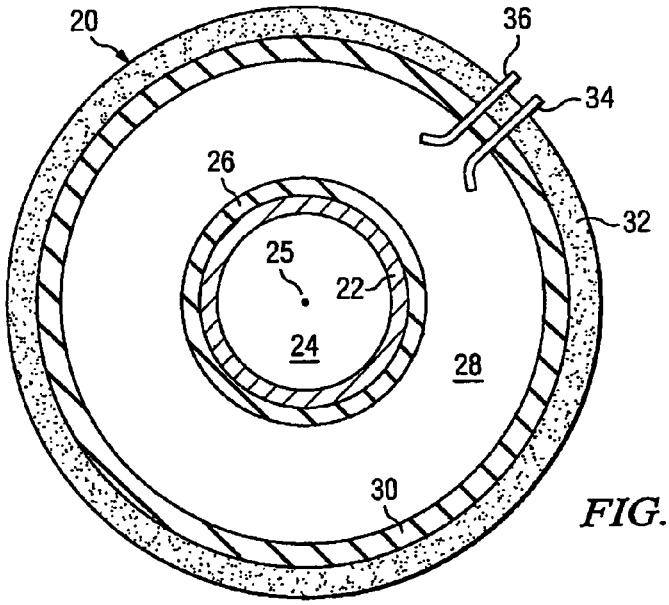
FIG. 1 is a cross-sectional view of a composite riser of the present invention.

FIG. 1 is a cross-sectional view of one embodiment of a riser of the present invention. The figure is not to scale for purposes of illustration. Composite riser 20 has an inner liner 22 which defines passageway 24. Liner 22 is preferably of a metal such as steel, aluminum or titanium. Adjacent to liner 22 is shear ply 26. Shear ply 26 is a rubber of polymeric material. Further, the shear ply is preferably fluid impermeable. Placed over shear ply 22 is the main structural layer 28. The main structural layer 28 is of a composite material. Covering the outer side of structural layer 28 is a fluid impermeable layer 30 preferably made of rubber that is covered by a scuff absorbing layer 32. In this embodiment, two fiber-optic strain sensors 34 and 36 are embedded in the riser below the outer fluid impermeable layer 30. Preferably, they are embedded in the area of the metal-composite interface. It will be understood by those skilled in the art that the specific design of the riser is not limited to the illustrated design. In a preferred embodiment, the composite riser has an elastic axial modulus of from 5 to 15 million pounds per square inch, and more preferably a value from 10 to 14 million pounds per square inch. Risers with an elastic modulus within these ranges can be provided by known techniques and methods of construction using finite analysis to design the composite structure.

Figure 2:
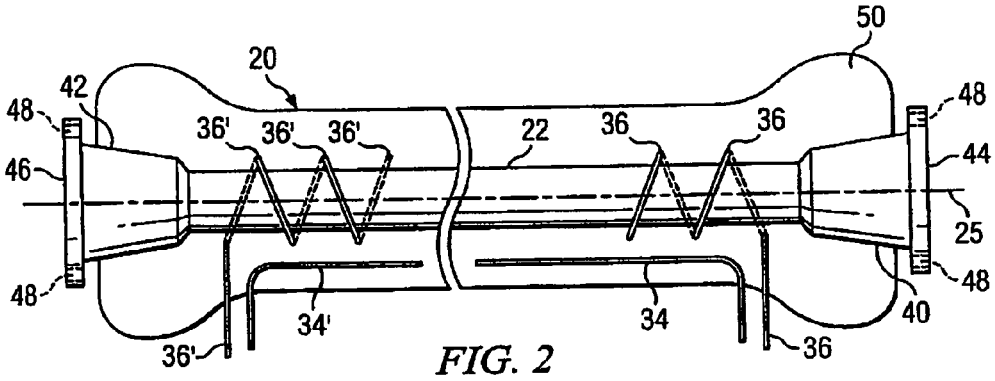
FIG. 2 is a cross-sectional view of a composite riser of the present invention.
Figure 3:
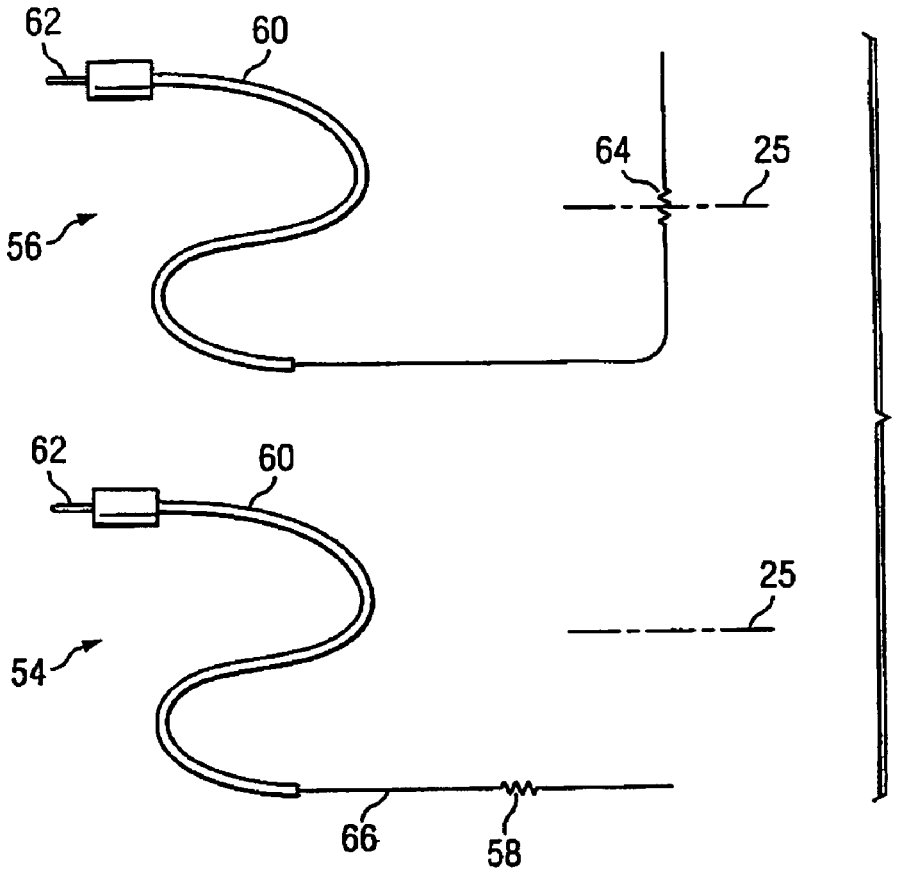
FIG. 3 is a schematic representation of orientation of separate fiber optic strain sensors of the present invention.

For the fiber optic strain sensors, the same fiber can contain multiple sensors. (See FIG. 4.) These sensors are generally formed by machining a grating (Bragg grating) in the fiber. When laying the optical fiber, some of the sensors will be positioned to monitor the axial strains (See FIG. 1, sensor 34; FIG. 2, sensor 34; FIG. 3, sensor 58; and FIG. 4, sensor 67.) while the others are positioned to monitor the hoop strain (See FIGS. 1, sensor 36; FIG. 2, sensor 36; FIG. 3, sensor 64; and FIG. 4, sensor 68). In order to monitor these sensors, the ends of the fiber containing the sensors pass through fluid impermeable layer 30 and the scuff barrier 32 to the outside for connection to the monitoring device. Typically the composite riser 20 will be constructed by winding the composite fibers over the liner. Normally in such construction there are fibers which are positioned longitudinal or substantially parallel to the axis 25 of passageway 24 and also fibers, usually referred to as hoop fibers, in one or more directions running in a direction substantially offset from the axis, such as circumferential, spiral, helical, etc. Preferably, the fiber optic strain gauges are embedded in the riser during production of the riser. Thus, it is convenient for them to be positioned in orientations corresponding to the orientation of longitudinal fibers and to the hoop fibers. Preferably, one of the strain gauges is oriented substantially parallel to the axis of the riser to measure axial strain. The other strain gauge is preferably positioned and embedded along the orientation of one of the hoop fibers. In the hoop orientation the strain sensor will be available to measure the hoop strain. Preferably, the orientation of the strain sensor embedded in the hoop direction is substantially perpendicular to the axis of the riser. In a less desired embodiment, the orientation of the strain sensor embedded in the hoop direction is at an angle within 30 degrees of the perpendicular to the axis. The orientation of the other strain gauge should be substantially longitudinal and preferably is parallel or not more than 20 degrees from being parallel to the axis of the riser. The preferred location for the fiber optic strain gauge is in the main structural layer but they can be positioned elsewhere if desired.

FIG. 2 is a simplified cross-sectional view of composite riser 20. On the interior of the riser is metal liner 22 along axis 25. On each end of the liner are attached metal composite interface portions 40 and 42. Metal composite interfaces 40 and 42 are provided with metal connectors 44 and 46 respectively. In this example, flanges are shown, but other commonly used oilfield connectors such as pin and box threaded joints can be considered. These metal connectors can contain holes 48 through which bolts or other fasteners can be passed to connect two or more risers together. The layers surrounding the liner 22 and the metal composite interfaces 40 and 42 are generally indicated as 50. The details of the layers have been omitted for purposes of clarity. In this illustrated embodiment, two longitudinally oriented strain gauges 34 and 34' are provided. These are illustrated as extending some length along the riser axis. The particular length and number of these first strain gauges is a matter of choice. Also, if desired the various first strain gauges can be installed at different depths within the structural composite layers 50.

Two second strain sensors 36 and 36' are shown in the hoop orientation. These strain gauges are helically wrapped about the axis 25 and within the outer layers 50. Like the first strain sensors 34, second strain sensors 36 can be positioned at various depths. Also, one or more second strain sensors can be employed. As illustrated in FIG. 2, second strain sensors 36 and 36' are wrapped in a helical fashion or about the axis. The preferred orientation for the second strain sensors is along the circumference of the risers, i.e. 90 degrees off of the axis 25.

The fiber optic strain gauges are preferably embedded in the structural layer 28. The strain gauges are also preferably positioned such that they are adjacent to the portions of the riser 20 most likely to be damaged or to fail, which is typically the metal-composite interface area.

Figure 4:
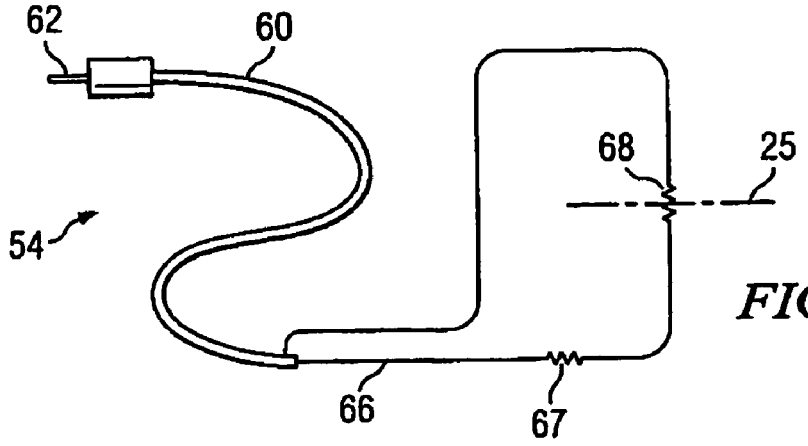
FIG. 4 is a schematic representation illustrating the use of a single fiber optic strain sensor for both axial and hoop measurement.

FIG. 3 illustrates the fiber optic axial sensors 54 and the hoop sensor 56 that can be used for measuring the axial strain and the hoop strain. FIG. 3 shows the use of a separate fiber for each strain sensor. Axial strain sensor 54 has an axial fiber optic strain sensor portion 58, a fiber optic tail portion 60 connecting the axial strain sensor portion 58 to lead 62 for connecting to monitoring equipment. Hoop strain sensor 56 can have the same construction as axial strain sensor 54, except that the hoop strain sensor portion 64 is positioned substantially perpendicular to the axis 25. FIG. 4 illustrates the use of single optical fiber 66 having a strain sensor section 67 and a hoop strain sensor section 68, to measure both axial and hoop strain. If desired more than several sensors can be provided per optical fiber to provide for redundancy as well as temperature compensation.

Figure 5:
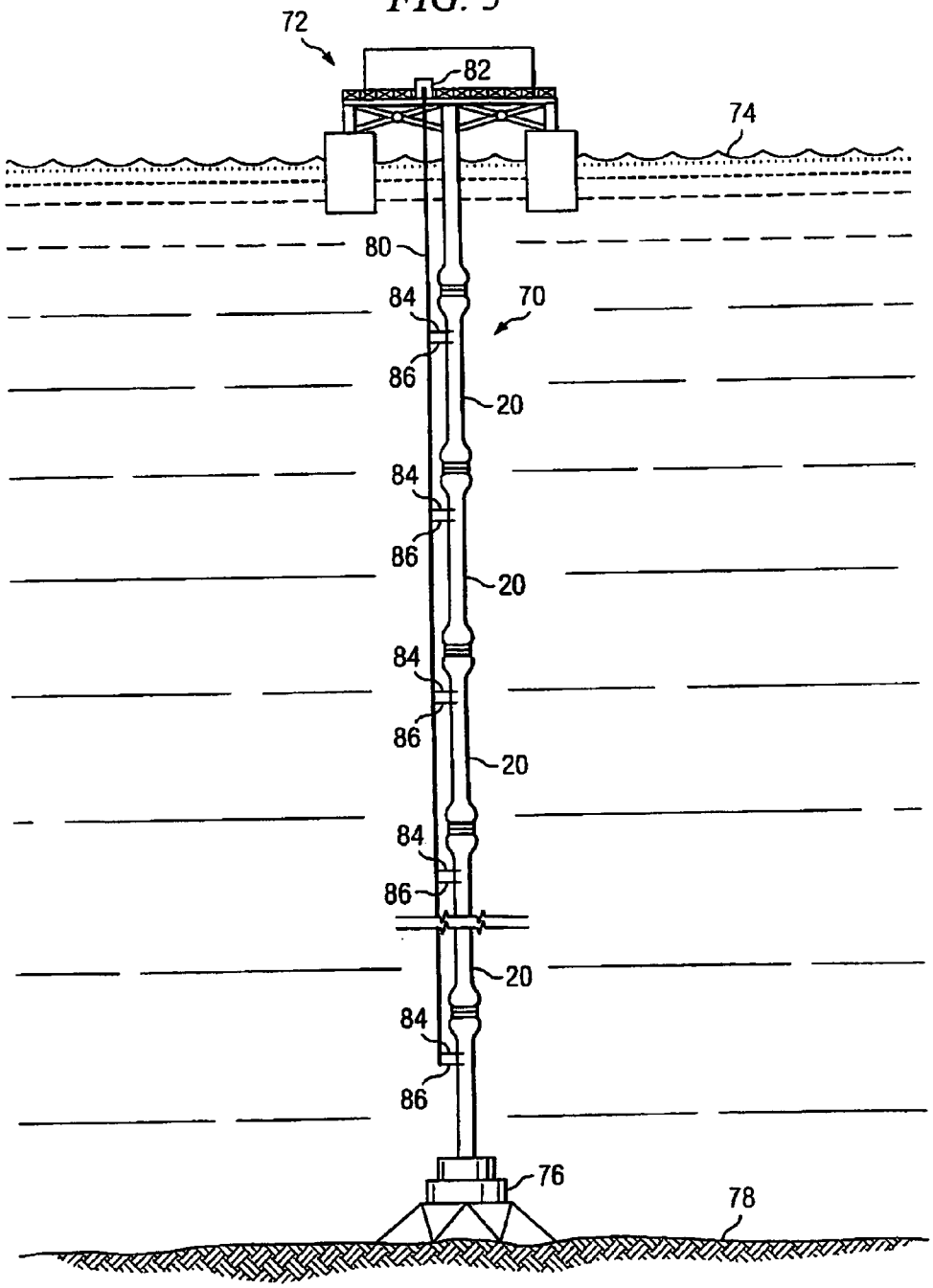
FIG. 5 is a riser string and control system of one embodiment of the present invention.

FIG. 5 illustrates another embodiment of the present invention. FIG. 5 illustrates riser string 70 composed of a number of individual risers 20. The top of the riser string 70 is connected to a surface platform 72 on the surface 74 of the ocean. The lower portion of the riser string 70 is connected to the wellhead 76 on the sea bed floor 78. In this embodiment, a transmission line 80 extends from the surface platform 72 along the riser string 70 and is connected to leads 84 and 86 to the first and second strain gauges in the separate riser sections 20. In the illustration, each riser 20 has its strain gauges connected to the transmission line 80. The transmission line 80 can be attached to the outside of the riser string or embedded in the risers 20. However, only a selected riser joint 20 can be monitored if desired. In a preferred embodiment, each riser joint 20 is monitored.

Transmission line 80 is connected to controller 82. Signals can be sent from controller 82 to the various strain gauges on the various risers 20 and the measured strain data on one or more selected strain gauges is returned. Transmission line 80 may be a single common line for a plurality of risers 20, or may be a bundle of transmission lines, one for each riser. Well known electrical addressing techniques may be used in the case of a common transmission line 80 for communicating with a selected one of a plurality of risers connected to that line. Measured strain can be displayed to the user, recorded in a databank, or compared against a preset warning level, which if reached, causes an alarm signal, such as a light, sound, etc. to be activated. Preferably, the controller 82 records the date, time and measured data for each riser and the identification of the riser. This provides a historical record of measured data to be used to improve riser design, predict the life cycles, and to identify risers in need of preventative replacement.

Figure 6:
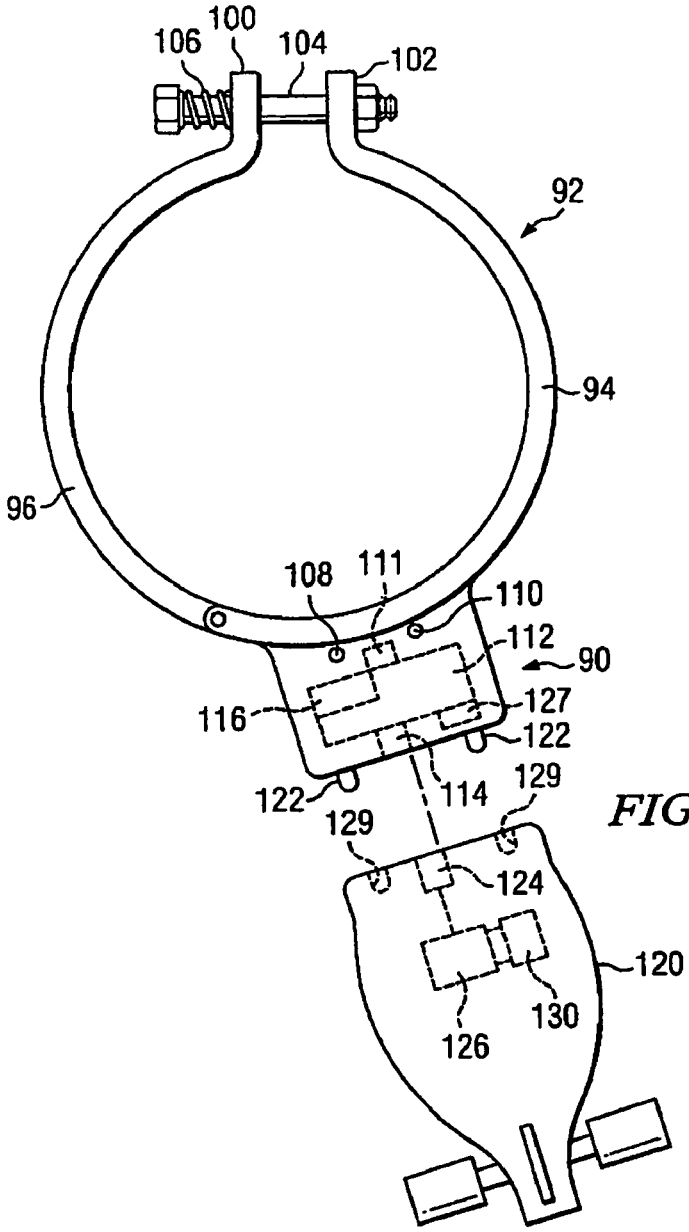
FIG. 6 is a side view of a riser with electromagnetic strain sensors in another embodiment of the invention.

FIG. 6 illustrates another embodiment of the present invention. A transmission line 80 extending along the length of riser string 70 has certain drawbacks, including the difficulty of installation and protection from damage. Thus, in another embodiment of the present invention, a monitoring module 90 is provided. The monitoring module 90 is provided with a means to attach it to the riser, such as a collar 92 for mounting on riser 20. In the illustrated embodiment, collar 92 has a first arm 94 hingedly connected to a second arm 96 by a hinge. Arms 94 and 96 at their free ends 100 and 102 are provided with holes through which a bolt 104 can pass. In a preferred embodiment, a spring 106 is provided on the outside of one of the free ends. Spring 106 serves to bias arms 94 and 96 against the outside of riser 20, to compensate for any decrease in riser diameter as it is subjected to increasing pressure the further it is extended into the sea. Of course other types of connections are equally suitable such as clamp, fasteners or even glue. The module 90 is provided with connectors 108 and 110 to connect to the leads of first and second strain sensor. Thus, the strain sensors are connected to a signal device 111 and control device module 112. Control device 112 has attached to it output/input communication device 114 which is described further below. Control device 112 can be a battery powered computer processor 116.

Preferably, the processor 116 is programmed to initiate a signal or prompt the signal device to send a signal to the first and second strain sensors at a predetermined time or on command. The processor may be any type of computer, microcomputer, microprocessor, or digital or analog signal processor. The strain data from each sensor in response of the signal is received and processed by the processor 116. In one embodiment, the signal received can be compared against a predetermined strain data value corresponding to a warning limit. Preferably, the strain data is stored in a memory for later download. In a preferred embodiment, the memory is located inside the module 90. The processor is also connected to one or more output/input communication device 114. The output/input communication device can be in the form of acoustic transceiver, a hard connection to the transmission line, optical link or other means. In one embodiment, the strain data is stored in module 90 until a submersible vehicle 120 aligns with the communication device for inputting and outputting stored data from the control device 112. The stored strain data can be downloaded to a recorder 126 on the submersible vehicle 120. The submersible vehicle 120 can then be recovered at the surface and the data obtained from the module extracted for use.

In another embodiment, the control device 112 can also include an acoustic generator 127 as a communication device. Strain data values can then be transmitted directly to the surface acoustically. Alternatively, strain data values can be stored until downloaded to the remote vehicle 120. Preferably, even in the situation where strain data values are stored an immediate action is desirable in the event that the warning limit is exceeded, in which case an acoustic signal is transmitted to the surface to activate an alarm on the surface platform.

The monitoring module 90 can be provided with a capability or fixture for aligning the submersible 120, such as projection 122, to assist in aligning the communication terminal 114 of the monitoring module 90 in position to communicate with the communication device 124 of the recorder 126 of the submersible 120. The submersible vehicle can also have an alignment means such as recesses 129 to receive projections 122. The submersible may be of any known design for submersible vehicle and preferably is remotely controlled from the surface platform. The submersible 120 is equipped with a recorder 126. The recorder 126 can include a control element to signal the control device 112 of the monitoring module 90 to download data. In one embodiment, the submersible is positioned such that the communication means 124 of the submersible and communication device 114 of the monitoring module 90 are in communication and strain data is downloaded to the recorder 126 on the submersible for later recovery and processing at the surface. One type of self contained monitoring module system is disclosed in U.S. Pat. No. 4,663,628. Details of the internal operation of monitoring module 90 are omitted as the construction and programming of microprocessor based data collection and storage systems is well known.

Alternatively, the submersible can include a control element 130 to directly initiate a signal to the strain sensor and then record the response strain measurement. In this embodiment, the monitoring module is not required. Instead, the submersible aligns with the leads to the fiber optic strain gauges and transmits a strain signal and records the response.

In another embodiment the strain sensor may be a piezoelectric strain sensor. Currently, these have the disadvantage that with the current technology they are rather bulky and are not as conveniently incorporated into the composite riser as are the fiber optic strain sensors. The piezoelectric strain sensors are connected to leads and the operation is like that as described in relation to the fiber optic strain sensors. The disadvantages of piezoelectric sensors may change over time rendering this type of sensor more desirable for use in implementations employing the present invention.

Figure 7:
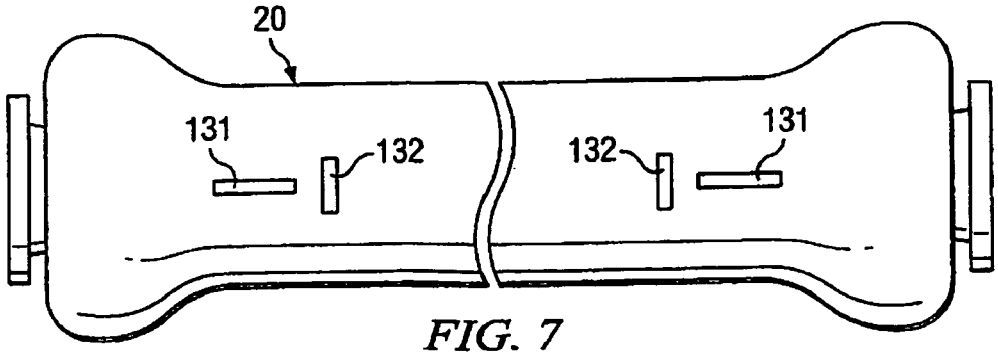
FIG. 7 is an illustration of one embodiment of a monitoring module and submersible vehicle of the present invention.

In yet another embodiment of the invention, the strain sensors are magnetic. Magnetic strain measurements have the advantage that a power supply mounted in a monitoring module is not needed. As illustrated in FIG. 7, first magnetic strain sensor 131 and second magnetic strain sensor 132 are strips of metal adhered or embedded into a composite riser. The magnetic gauge can be a wire of magnetic material bonded within the structure, or it can be a strip of magnetic material with a reduced cross-sectional area in the midportion of the strip which increases the sensitivity of the gauge. These magnetic gauges are passive in the sense that no direct connection to a circuit is required, and magnetic detection equipment is employed in conjunction with gauge. This detection equipment generates a magnetic field and measures the difference in the field caused by the gauge. The detection equipment can be contained in the submersible vehicle. Strain is measured by measuring the change in the magnetic field associated with changes in the magnetic sensor caused by strain. Thus, these magnetic strips can be adhered to the composite riser and the magnetic field monitored and recorded by a remote vehicle. Magnetic gauges may also be used with a monitoring module to simplify the attachment of the monitoring module and to obviate the need for electrical or optical connections to the module.

In yet another embodiment, the strain gauge can be a resistance gauge or an acoustic gauge. An acoustic strain gauge is shown in U.S. Pat. No. 5,675,089 entitled "Passive Strain Gauge" and is incorporated herein by reference.

In yet another embodiment, accelerometers are used to measure the vibration response for determining strain data. The vibration signal can be analyzed by any number of means including frequency transform using fast Fourier transform algorithmic analysis to detect variations in natural frequency and shift in phase angle.

Testing for Setting Warning Values

For each composite riser design, testing of the riser should be performed and measurements of changes in axial displacement, axial and hoop strains, and vibration signature during pressure testing recorded. This testing allows one to empirically determine values to be employed as warning limits in the monitoring of integrity in the operational environment. Preferably, the strain sensors are installed in the test riser at selected locations during fabrication. The accelerometers are mounted on the riser joint after fabrication. This test riser is then subjected to a sequence of increasingly severe loads that are intended to create damage in the test specimen. An example of such testing protocol is described below and is summarized in Table 1.

TABLE 1

| Load Sequence | Load Case | Comment |
|---|---|---|
| 1 | Pressure to 427.5 bar (6200 psi) and hold for 5 min. | |
| 2 | Pressure to 427.5 bar and hold for 15 min. | |
| 3 (FPT 1) | Pressure to 315 bar (4500 psi) and hold for 5 min. | Baseline measurement |
| 4 (FPT 2) | Pressure to 315 bar. | |
| 5 | Axial load to 2060 kN without internal pressure. | |
| 6 | Axial load to 2060 kN without internal pressure. | |
| 7 | Axial load to 2060 kN with 30 bar internal pressure. | |
| 8 | Axial load to 2060 kN with 30 bar internal pressure. | |
| 9 (FPT 3) | Pressure to 315 bar. | |
| 10 | Axial load 2550 kN with 30 bar internal pressure and hold at max. load for 5 min. | First extreme axial load sequence. |
| 11 | Cyclic axial load between 2060 kN and 2550 kN for 101 cycles 0.1 Hz, with 30 bar internal pressure. | First cyclic load sequence. |
| 12 (FPT 4) | Pressure to 315 bar. | |
| 13 | Axial load 4500 kN with 30 bar internal pressure. | |
| 14 | Cyclic axial load between 3500 kN and 4500 kN for 101 cycles 0.1 Hz, with 30 bar internal pressure. | |
| 15 (FPT 5) | Pressure to 315 bar. | |
| 16 | Axial load 5000 kN with 30 bar internal pressure. | |
| 17 | Cyclic axial load between 4000 kN and 5000 kN for 109 cycles 0.1 Hz, with 30 bar internal pressure. | |
| 18 (FPT 6) | Pressure to 315 bar. | |
| 19 | Axial load 5800 kN with 30 bar internal pressure. | |
| 20 | Cyclic axial load between 4800 kN and 5800 kN for 50 cycles 0.1 Hz, with 30 bar internal pressure. | |
| 21 | Cyclic axial load between 4700 kN and 5900 kN for 20 cycles 0.1 Hz, with 30 bar internal pressure. | |
| 22 | Cyclic axial load between 4600 kN and 6000 kN for 20 cycles 0.1 Hz, with 30 bar internal pressure. | Max axial load higher than predicted failure load of 5925 kN (1330 kips). |
| 23 | Cyclic axial load between 4400 kN and 6200 kN for 20 cycles 0.1 Hz, with 30 bar internal pressure. | |
| 24 (FPT 7) | Pressure to 315 bar. | |
| 25 | Axial load 6500 kN with 30 bar internal pressure. | Failure after 4:20 min at 6500 kN steady load. |
| 26 (FPT 8) | Pressure to 315 bar. | |
| 27 | Axial load 2060 kN with 30 bar internal pressure. | Same as 7 and 8. |

Figure 8:
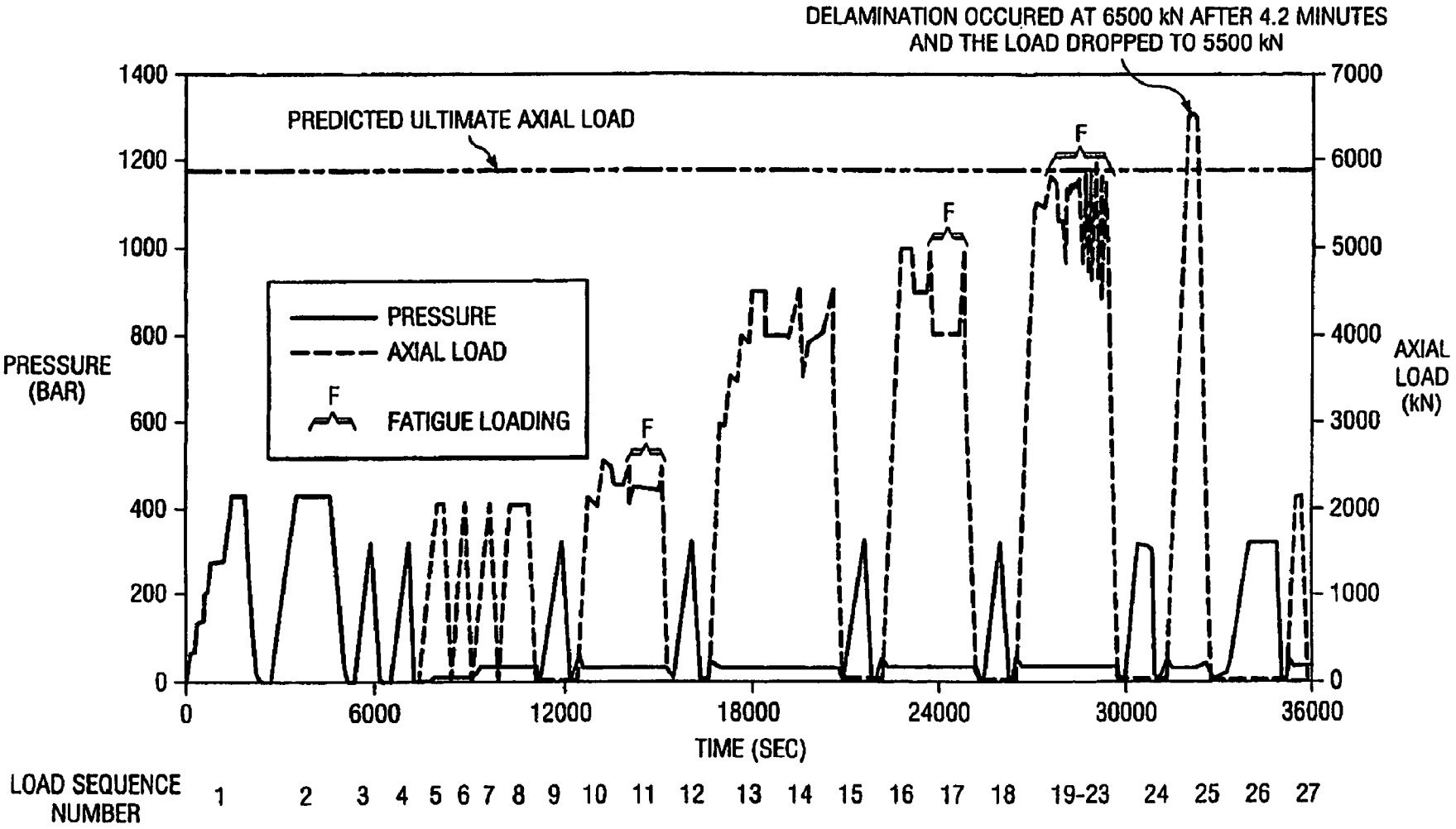
FIG. 8 is a graph of strain percentage for various test sequences.

FIG. 8 shows a graph of the sequence of loading tests to cause progressive damage to the composite riser. The x axis of FIG. 8 is the load sequence number for Table 1, and the y axis is pressure in bars. In an actual test performed by the inventors, the test specimen failed at load sequence 25 at an axial load 6,500 kN. Failure was detected by a loud bang and by a drop in the load from 6,500 kN to 5,500 kN. On visual inspection the riser had numerous small cracks on the outer surface at the middle of the riser and towards one end. The riser joint was cut open and it was found that the composite had delaminated between the two ends with visible cracks in the matrix in the hoop layers in the trap locks. Despite this amount of damage the riser integrity remained mostly intact. This was demonstrated by the subsequent ability of the specimen to withstand load sequences 26 and 27 that includes a pressure test of 315 bar and axial test 2,060 kN.

Figure 9:
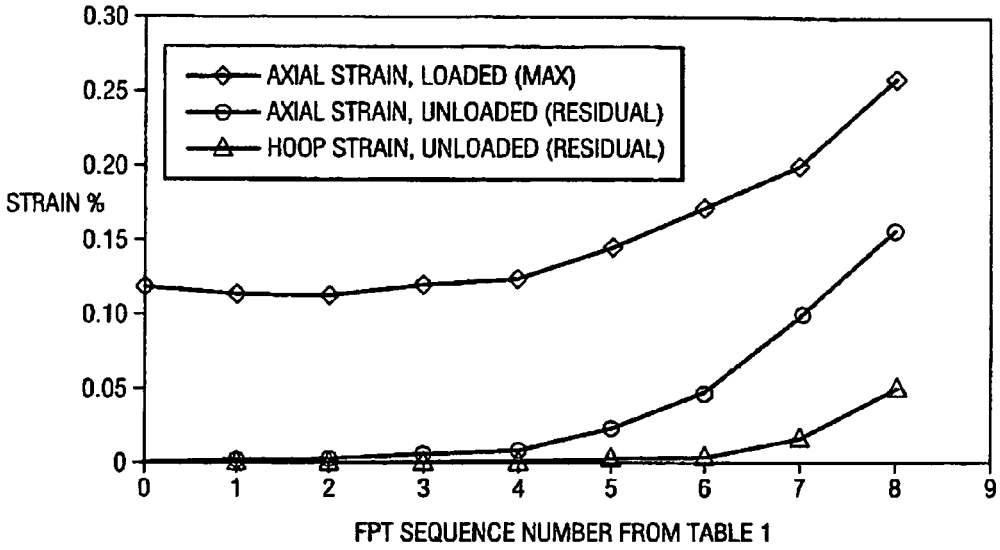
FIG. 9 is a graph of the ratio of hoop to axial strain for various test sequences.

During the testing, strain was monitored using both fiber optic sensors and strain gauges. In FIG. 9, the x axis shows the FPT sequence number from Table 1, while the measured axial strain during eight pressure cycles is shown on the y axis. FIG. 9 shows the changes in the axial strain when the joint is loaded and also the residual axial and hoop strains at zero loads. These results indicate the changes in the strains as a measure of damage.

Figure 10:
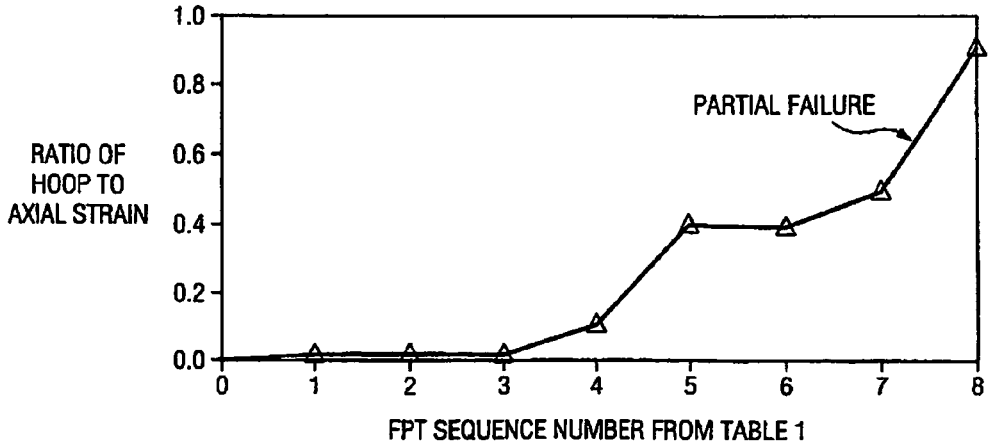
FIG. 10 is a schematic illustration of the control system of the present invention.

The measured strain clearly shows that the strain pattern changed over the test duration. Importantly, it was discovered that the ratio of the hoop strain to axial strain serves as an excellent indicator of progressive damage. FIG. 10 presents the changes in the strain ratio after different FPTs (the x axis shows the FPT sequence number from Table 1) as measured by fiber optic sensors embedded in the composite joint. As shown in FIG. 9, an indication of failure occurred when the longitudinal (axial) strain increased by about 100% (from 0.115 at the reference FPT to 0.2% for the FPT prior to when the failure was observed, see sequence number 7). Even when the strain increased by 100%, the hoop and axial load capacities were not compromised indicating that the riser still had sufficient capacity to be retrieved without compromising the safety of the riser. As a safety measure, a realistic criterion may be preferably set at a change in the strain of 50% for removal of the joint from service or other predetermined value. One benefit of the present invention is that historical data can be used to adjust the warning value based on in-service experience. Alternatively, as shown in FIG. 9, the residual axial or hoop strains at zero loads can also be used as an indicator of damage development as these values increase after severe loading cycles.

The measured strain clearly showed that the strain pattern changed over the test duration. Detailed analysis of the changes in the strain pattern demonstrate that the absolute value of the strain under load, the residual strain under zero load, and the ratio of the hoop strain to axial strain each serve as an excellent indicator of progressive damage.

The changes in the axial strain under constant load, as the joint is progressively damaged, means that the stiffness in the joint is decreasing, which can also be measured using vibration monitoring techniques. In another aspect, the present invention provides for using the natural vibration frequency of the riser to monitor the integrity of the riser. As the stiffness of the riser changes, its natural frequency, which is a function of the riser's stiffness and mass, will change and thus the riser's vibration signature will change. Although this is a well known technique, individual testing and the generation of custom strain curves is required to characterize a specific riser because configuration, cross-section, wall thickness, material selection, etc. will affect vibration response characteristics. Monitoring the changes in a riser's vibration signature, which is commonly done using accelerometers, can provide an indication of the level of damage to that riser. Because of the complexity of the composite structure, theoretical predictions of the relationship between level of damage and changes in strains or vibration signature are difficult. Therefore, calibration curves need to be developed as part of the riser qualification program.

While warning limits may be empirically determined as described above, warning limits may also be analytically determined based on predicted behavior of the structure so long as adequate models are available. What is pertinent for the current disclosure is not the details of well known modeling techniques, but, instead, how warning limits are utilized.

Control System

Figure 11:
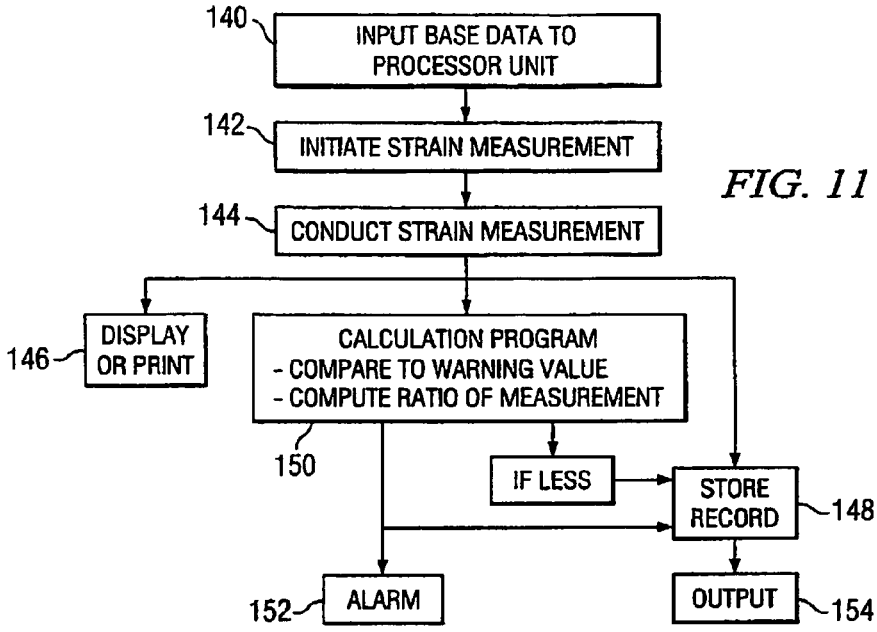
FIG. 11 is a schematic illustration of alternate embodiments of the distribution of control functions.

The control and monitoring functions can be consolidated at the controller 82 on the surface platform 72, or divided among the monitoring modules 90 on the composite risers 20 and the recorder 126 of the submersible vehicle 120. The control system and method will be discussed first as an overall system and method in reference to FIG. 11. It is understood that the specific components and functions can be implemented in different manners by different devices at different locations in the system. The functions can be performed by a computer, microcomputer or microcomputer based system programmed to perform the functions operating in conjunction with peripheral devices. Alternatively, some functions can be conducted by a circuit or device having specific functionality rather than a programmed computer.

In a preferred embodiment, an input device, block 140, such as communications port or interface is provided to input basic information into the processor. This information can include, an identification assigned to each individual riser to be monitored, clock settings, timing sequence for testing, and warning limits. The strain measurement sequence can be initiated on command inputted by the operator, or automatically based on a timing program or by input from sensors triggered by certain events, such as environmental conditions indicative of severe weather which could produce severe strain on the riser string. This function can be performed by a means to initiate measurement such as a keyboard, timing program, or inputted sensor signal, block 142.

The system includes a strain measurement signal generator and receiver of the return measured strain value, block 144. This can be performed by known strain measuring equipment for the type of gauge being employed. The measured strain in each orientation is inputted into the control system. The control unit preferably includes a visual output device, block 146, such as a display screen, printout, or other means to allow the operator to view the results. In a preferred embodiment, the processor also includes a capability to correlate the measured strain data, block 150, with the time at which the measurement was taken and a means for storage of that information, block 148. Additionally, it is preferred that the control system include a capability for calculating the ratio of strain data measured, block 150, in either the first or second direction against the strain measured in the other orientation. The ratio value is preferably stored together with the time that the measurements used to compute the ratio were taken. In a preferred embodiment, an input means such as a keyboard or a ROM chip is provided for input of the predetermined warning value for strain data in one or more of the first orientation, second orientation, and/or strain ratio indicative of a strain threshold on the riser predictive of damage or failure. The controlled processor preferably includes a means such as program code to compare the measured strain against the predetermined warning value, block 150.

The system preferably includes an alarm generating means such as a computer program which initiates an alarm 152 perceptible to the operator such as a visual display, sound, or other indicator. In the embodiment where a monitoring module is attached to the individual risers, this alarm means can include an acoustic signal generator in the monitoring module which sends acoustic signals to a receiver connected to the controller on the surface platform. The method of the present invention in a preferred embodiment involves the steps of inputting to the processor base data, which preferably includes warning limits, initiating strain measurement, conducting strain measurement, collecting strain data, and outputting the strain data. Preferably, the method also includes comparing the strain data against predetermined warning limits, outputting an alarm signal if the warning limit is exceeded. Additionally, the method also includes storing of the strain data.

When the control system includes monitoring modules on the individual risers, a submersible vehicle may be beneficially employed. Use of a UAV (Underwater Autonomous Vehicle) is desirable as it eliminates a need for a transmission line from each monitor to the surface. Also, the submersible is preferred in order to conserve power in the monitoring module's power system. It is also preferred that the control system include a storage device to store data and allow for a database of the measured strain for each riser and details of the riser construction. Suitable types of storage devices are well known and include semiconductor memory, RAM FLASH, etc. An output device 154 is provided to output in electronic, optic, magnetic, or other form this information which can then be either transferred to another computer processor, or visually displayed. Retention of a historical record can be desirably used to improve riser design and to perfect and refine appropriate warning limits.

Figure 12:
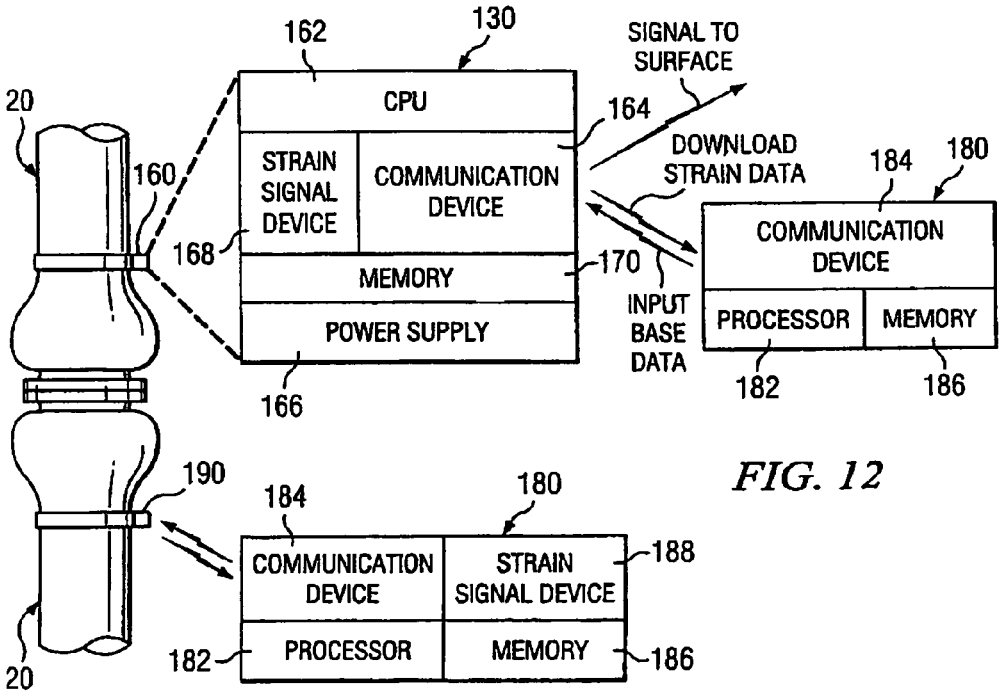
FIG. 12 is a schematic illustration of two embodiments monitor module attached to a riser, and a remote vehicle for monitoring the risers.

The monitoring system can be constructed in many different manners, and in a preferred embodiment, one or more monitoring modules 160 are attached to each riser 20 or selected risers within the string as illustrated schematically in FIG. 12. The monitoring module 160 contains a central processor unit 162, a communications device 164 to provide communication with the remote controlled submersible vehicle or to provide acoustic communication, optical communication or other communication with the surface platform. Processor unit 162 may be any suitable type of computer, computer module, microcomputer, microprocessor, or digital signal processor. The module further includes a power supply 166 such as a battery to power the unit, a signal device 168 and a memory device 170. The signal device 168 transmits and receives signals to and from the strain sensors.

The central processing unit 162 can be programmed in many different fashions to satisfy the needs of the user. Preferably, the unit has stored in memory an identification of the riser to which it is attached. This identification is used to correlate the output data of the strain or vibration sensors with the particular riser. The processor is programmed to receive command signals and/or a stored timing routine. The processor generates a signal to the signal device which initiates the delivery of a signal to the strain sensor, the return signal is received by the signaling device and the strain value is compared to the warning limit. Similarly, the strain measured in the second orientation is compared against warning limits. The ratio of the strain measured in the first orientation with that measured in the second orientation within a predetermined time is computed and compared against the stored warning limit. If the warning limit is exceeded, the processor can generate a command to the communication device to send an alarm signal to the surface. It is not necessary to make the comparison to the warning limits. Preferably, all measurements made are then stored in the memory device 170. Preferably, the data stored includes the time of the measurement, strain measured in the first direction, strain measured in the second direction, and a ratio of the strain measured in the two orientations. The processor is further programmed to download the stored data upon receipt of a command from the recorder unit 180 in the submersible vehicle or from the surface controller. The recorder unit 180 contains a processor 182, a communication device 184, and a memory device 186. The recorder can be powered by the power supply of the submersible vehicle. The submersible vehicle can also include lights and video equipment commonly used for underwater visual inspection. The recorder 180 can input into monitoring module 160 new base information updates such as a change in the warning limit and accept downloads of strain data from the monitoring module 160. This arrangement can be repeated for each riser.

FIG. 12 shows another embodiment in the lower half of the figure. One or more alignment devices 190 is preferably provided adjacent to the strain sensors. The use of an alignment device is useful when the strain sensors are magnetic sensors. The alignment device allows for the consistent positioning of a submersible vehicle with an embedded magnet sensor, thereby allowing the submersible vehicle to align with the strain sensors and take measurements. In this embodiment, the recorder 180 includes a strain signal device 188, for example, a magnetic field generator and sensor to measure strain in embedded magnetic strain sensors 131 and 132 (see FIG. 7). Preferably, the downloaded data includes the stored strain measurement data as well as identification of the riser. The data stored in the memory of the recorder is recovered when the vehicle is brought to the surface. The various steps of the measuring and the functioning of the system can be performed either by the surface controller, by the modules, or by the recorder in the submersible vehicle if employed.

Further details of the internal operation of the monitoring modules is omitted for simplicity because the electronic and microcomputer based systems for recording and storing data are well known in the art. For example see U.S. Pat. No. 4,663,628. Accordingly, what is pertinent to the current disclosure is the functions performed by the module, how the modules are accessed and/or interconnected and where and how the modules are placed. Similarly, exterior structural characteristics of the modules is not discussed as this is well known. What is pertinent to this disclosure is that the modules must be rugged and be able to withstand the harsh environment and pressure to which they will be subject without an unacceptable rate of loss of stored data.

Figure 13:
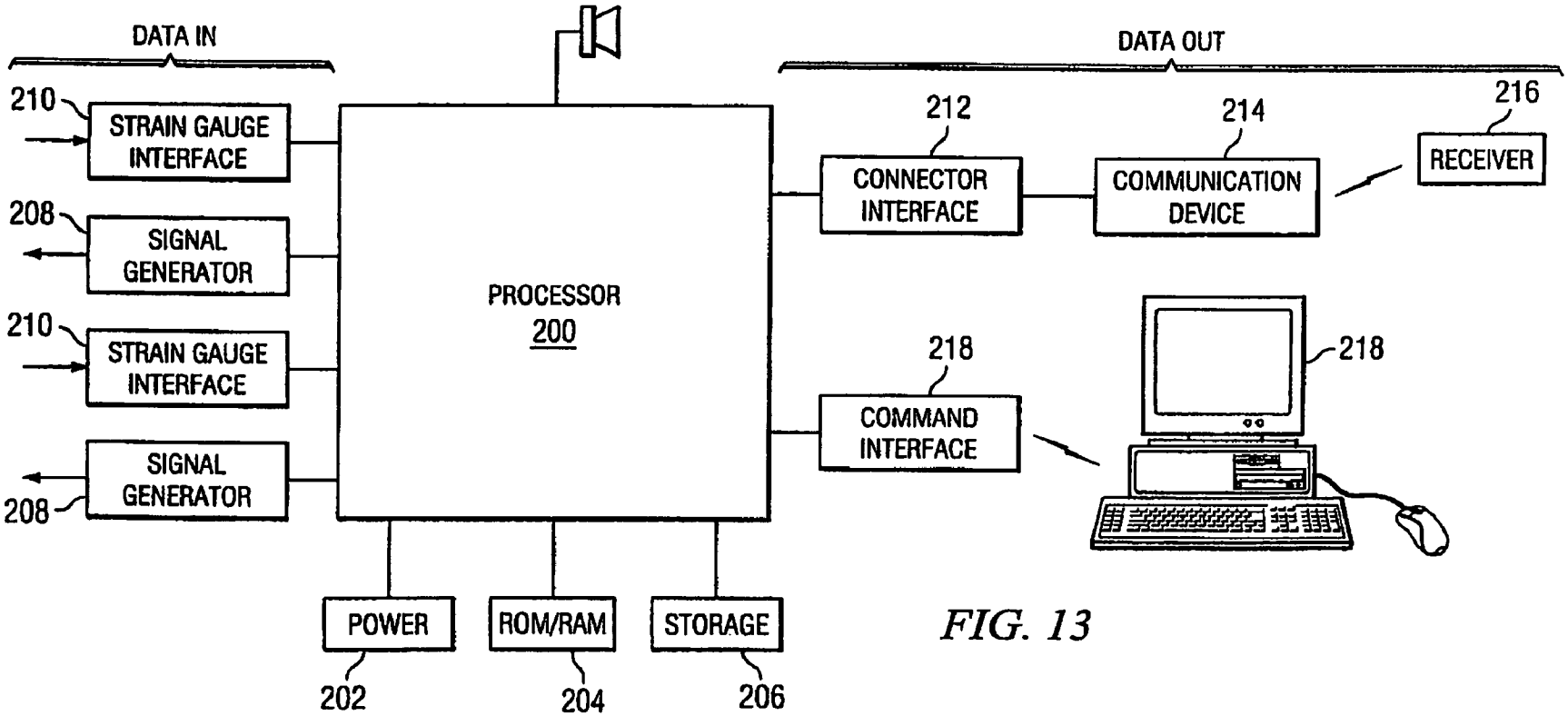
FIG. 13 is a schematic illustration of a monitoring module.

FIG. 13 is a schematic illustration of a monitoring system. Processor 200 is provided, and is powered by a power source 202, for example a battery, the processor has ROM and RAM memory 204, and can be connected to a storage device 206. The processor is connected to at least one signal generator 208, and strain gauge interface 210. Preferably the processor 200 has a connector interface 212, and a communication device 214. The communication device inputs from and outputs to receiver 216 data. A command interface 218 can be provided for receiving commands from a command input device such as a microcomputer.

While the present invention has been described in relation to various embodiments, the invention is not limited to the illustrated embodiments.

What is claimed is:

1. An underwater, composite riser assembly having an axis comprising:

a surface platform for supporting composite risers;

at least one composite riser having a vibration signature and supported by said platform, at least one of said one composite risers having a first strain sensor embedded thereto;

wherein said at least one composite riser is further comprised of a first and second end, a metal liner, and metal composite interfaces attached to each of said first and second ends, and furthermore, wherein said strain sensors are positioned near said metal composite interfaces;

a controller located at said surface platform;

said controller being in signal communication with said first strain sensor in said at least one composite riser; and said controller having a signal device capable of transmitting signals to and receiving signals from said first strain sensor in said at least one composite riser.

2. A riser assembly of claim 1 wherein said controller includes an output means to display the measured strain data.

3. A riser assembly of claim 1 wherein said controller has a memory device for storage of strain data.

4. A riser assembly of claim 1 wherein said controller compares measured strain data to a predetermined warning value.

5. A riser assembly of claim 1 wherein said first strain sensor is in a first orientation and further comprising a second strain sensor in at least one or said composite risers, said second sensor being in a second orientation.

6. A riser assembly of claim 5 further comprising at least one vibrational sensor mounted to said at least one composite riser to establish changes in a vibration signature in said first and second orientations.

7. A riser assembly of claim 6 wherein said changes in a vibration signature indicate damage to said riser assembly.

8. A riser assembly of claim 5 wherein said first orientation is from being parallel to said axis to being not more than 20 degrees from being parallel to said axis, and said second orientation is at an angle perpendicular to said axis to an angle not more than 30 degrees of being perpendicular to said axis.

9. A riser assembly of claim 5 wherein said first and second strain sensors are embedded in said at least one composite riser.

10. A riser assembly of claim 1 wherein said strain sensor is selected from the group consisting of fiber optic strain gauges, magnetic strain gauges, and electrical resistance strain gauges.

11. A riser assembly of claim 1 wherein said signal communication is provided by a transmission line from said platform to said strain sensors.

12. A riser assembly of claim 1 wherein said signal communication is provided by acoustic modems.

13. A riser assembly of claim 1 wherein said composite has an elastic axial modulus of from 5 to 15 million pounds per square inch.

* * * * *